US010315872B2

(12) United States Patent
Yamamoto

(10) Patent No.: US 10,315,872 B2
(45) Date of Patent: Jun. 11, 2019

(54) PAPER SHEET HANDLING MACHINE AND METHOD FOR CONTROLLING PAPER SHEET HANDLING MACHINE

(71) Applicant: FUJITSU FRONTECH LIMITED, Inagi (JP)

(72) Inventor: Takeshi Yamamoto, Inagi (JP)

(73) Assignee: FUJITSU FRONTECH LIMITED, Inagi (JP)

( * ) Notice: Subject to any disclaimer, the term of this patent is extended or adjusted under 35 U.S.C. 154(b) by 0 days.

(21) Appl. No.: 15/906,656

(22) Filed: Feb. 27, 2018

(65) Prior Publication Data

US 2018/0186587 A1 Jul. 5, 2018

Related U.S. Application Data

(63) Continuation of application No. PCT/JP2015/077844, filed on Sep. 30, 2015.

(51) Int. Cl.
*B65H 7/20* (2006.01)
*G07D 11/16* (2019.01)
(Continued)

(52) U.S. Cl.
CPC ..... *B65H 7/20* (2013.01); *B65H 5/26* (2013.01); *B65H 5/38* (2013.01); *G07D 9/00* (2013.01);
(Continued)

(58) Field of Classification Search
CPC ... B65H 7/20; B65H 2402/10; B65H 2557/25
See application file for complete search history.

(56) References Cited

U.S. PATENT DOCUMENTS 5,270,772 A * 12/1993 Akiyama ..... H05K 5/0021 206/501
5,666,595 A * 9/1997 Sameshima ..... G03G 15/00 24/658
(Continued)

FOREIGN PATENT DOCUMENTS

JP 2000-81827 3/2000
JP 2002-99943 4/2002
(Continued)

OTHER PUBLICATIONS

International Search Report dated Jan. 12, 2016 in corresponding International Patent Application No. PCT/JP2015/077844.
(Continued)

*Primary Examiner* — Howard J Sanders
(74) *Attorney, Agent, or Firm* — Staas & Halsey LLP

(57) ABSTRACT

A machine includes multiple types of paper sheet handling units, each of which includes a conveying mechanism for conveying a banknote and performs a different handling process on the banknote; and a controller that controls the paper sheet handling units. Each of the paper sheet handling units includes a connecting portion that connects conveying paths of the conveying mechanisms, and the connecting portions are provided in common positions among the paper sheet handling units. The controller detects types of the paper sheet handling units and relative positions of the paper sheet handling units in a conveying pathway of the banknote, with respect to the paper sheet handling units that are connected via the connecting portions, and controls each of the paper sheet handling units based on the type and the relative position.

6 Claims, 13 Drawing Sheets

(51) Int. Cl.

| | |
|---|---|
| ***B65H 5/38*** | (2006.01) |
| ***G07D 9/00*** | (2006.01) |
| ***B65H 5/26*** | (2006.01) |

(52) U.S. Cl.

CPC ..... *G07D 11/16* (2019.01); *B65H 2402/10* (2013.01); *B65H 2557/25* (2013.01); *B65H 2701/1912* (2013.01)

(56) References Cited

U.S. PATENT DOCUMENTS

| | | | | |
|---|---|---|---|---|
| 6,164,638 | A | 12/2000 | Owens et al. | |
| 7,203,445 | B2 * | 4/2007 | Uchida | G03G 15/6511 292/113 |
| 8,246,046 | B2 | 8/2012 | Taniyama et al. | |
| 8,585,036 | B2 * | 11/2013 | Yogev | B41J 3/4075 271/9.01 |
| 8,608,154 | B2 * | 12/2013 | Yamada | G03G 15/6502 271/164 |
| 8,894,059 | B2 * | 11/2014 | Yoshida | B65H 5/00 271/145 |
| 2002/0180136 | A1 | 12/2002 | Amari et al. | |
| 2005/0078864 | A1 | 4/2005 | Amari et al. | |
| 2010/0007080 | A1 | 1/2010 | Kotani | |
| 2011/0133395 | A1 | 6/2011 | Taniguchi et al. | |
| 2015/0048197 | A1 | 2/2015 | Hata et al. | |

FOREIGN PATENT DOCUMENTS

| | | |
|---|---|---|
| JP | 2002-104704 | 4/2002 |
| JP | 2008-213413 | 9/2008 |
| JP | 2013-144446 | 7/2013 |
| RU | 2171770 | 8/2001 |
| WO | WO 2013/069046 A1 | 5/2013 |
| WO | WO 2013146173 | 10/2013 |

OTHER PUBLICATIONS

Written Opinion of the International Searching Authority dated Jan. 12, 2016 in corresponding International Patent Application No. PCT/JP2015/077844.

Office Action, dated Nov. 22, 2018, in Russian Application No. 2018109510 (11 pp.).

Office Action, dated Dec. 24, 2018, in Chinese Application No. 201580083255.1 (16 pp.).

* cited by examiner

FIG.9

| | SSEL7 | SSEL6 | SSEL5 | SSEL4 | SSEL3 | SSEL2 | SSEL1 |
|---|---|---|---|---|---|---|---|
| UNIT IN FIRST LAYER | L | H | H | H | H | H | H |
| UNIT IN SECOND LAYER | H | L | H | H | H | H | H |
| UNIT IN THIRD LAYER | H | H | L | H | H | H | H |
| UNIT IN FOURTH LAYER | H | H | H | L | H | H | H |
| UNIT IN FIFTH LAYER | H | H | H | H | L | H | H |
| UNIT IN SIXTH LAYER | H | H | H | H | H | L | H |
| UNIT IN SEVENTH LAYER | H | H | H | H | H | H | L |

PAPER SHEET HANDLING MACHINE AND METHOD FOR CONTROLLING PAPER SHEET HANDLING MACHINE

CROSS-REFERENCE TO RELATED APPLICATION

This application is a continuation application of International Application PCT/JP2015/077844, filed on Sep. 30, 2015 and designating the U.S., the entire contents of which are incorporated herein by reference.

FIELD

The present invention relates to a paper sheet handling machine and a method for controlling the paper sheet handling machine.

BACKGROUND

As one example of a banknote handling machine according to a related art, there is a known machine in which a discriminating unit that discriminates banknotes, a holding unit that temporarily stores therein the discriminated banknotes, a storage unit that stores therein the banknotes, a collecting unit that collects the banknotes, and the like are arranged with respect to a conveying mechanism that conveys the banknotes. This type of the banknote handling machine is manufactured by selecting each of the units, which perform banknote handling processes, depending on the use of the machine, and the configuration differs for each specification of the banknote handling machine.

Furthermore, as a conventional banknote handling machine, there is a known machine in which an optional number of storage units can be added.

Patent Literature 1: Japanese Laid-open Patent Publication No. 2002-104704

As described above, a wide variety of banknote handling machines with different specifications are manufactured by changing an arrangement position of each of the discriminating unit, the holding unit, the storage unit, the collecting unit, and the like with respect to a conveying path of the conveying mechanism or by changing a configuration of each of the units, depending on the specification required for each of the banknote handling machines. Therefore, there is a problem in that the productivity of the banknote handling machines with different specifications is low.

The disclosed technology has been made in view of the above-described circumstances, and an object is to provide a paper sheet handling machine and a method for controlling the paper sheet handling machine, which make it possible to easily construct a banknote handling machine with a desired specification.

SUMMARY

According to an aspect of the embodiments, a paper sheet handling machine includes: multiple types of paper sheet handling units, each of which includes a conveying mechanism for conveying a paper sheet and performs a different handling process on the paper sheet; and a controller that controls the multiple types of the paper sheet handling units, wherein each of the multiple types of the paper sheet handling units includes a connecting portion that connects conveying paths of the conveying mechanisms, the connecting portions are provided in common positions among the multiple types of the paper sheet handling units, and the controller detects types of the paper sheet handling units and relative positions of the paper sheet handling units in a conveying pathway of the paper sheet, with respect to the multiple types of the paper sheet handling units that are connected via the connecting portions, and controls each of the multiple types of the paper sheet handling units based on the type and the relative position.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 9 is a diagram for explaining setting with which the controller recognizes the relative position of each of the banknote handling units in the banknote handling machine according to the embodiment.

DESCRIPTION OF EMBODIMENTS

Embodiments of a paper sheet handling machine and a method for controlling the paper sheet handling machine disclosed in the present application will be described in detail below based on the drawings. The paper sheet handling machine and the method for controlling the paper sheet handling machine disclosed in the present application are not limited by the embodiments below.

Embodiment (Configuration of a Banknote Handling Machine)

Figure 1:
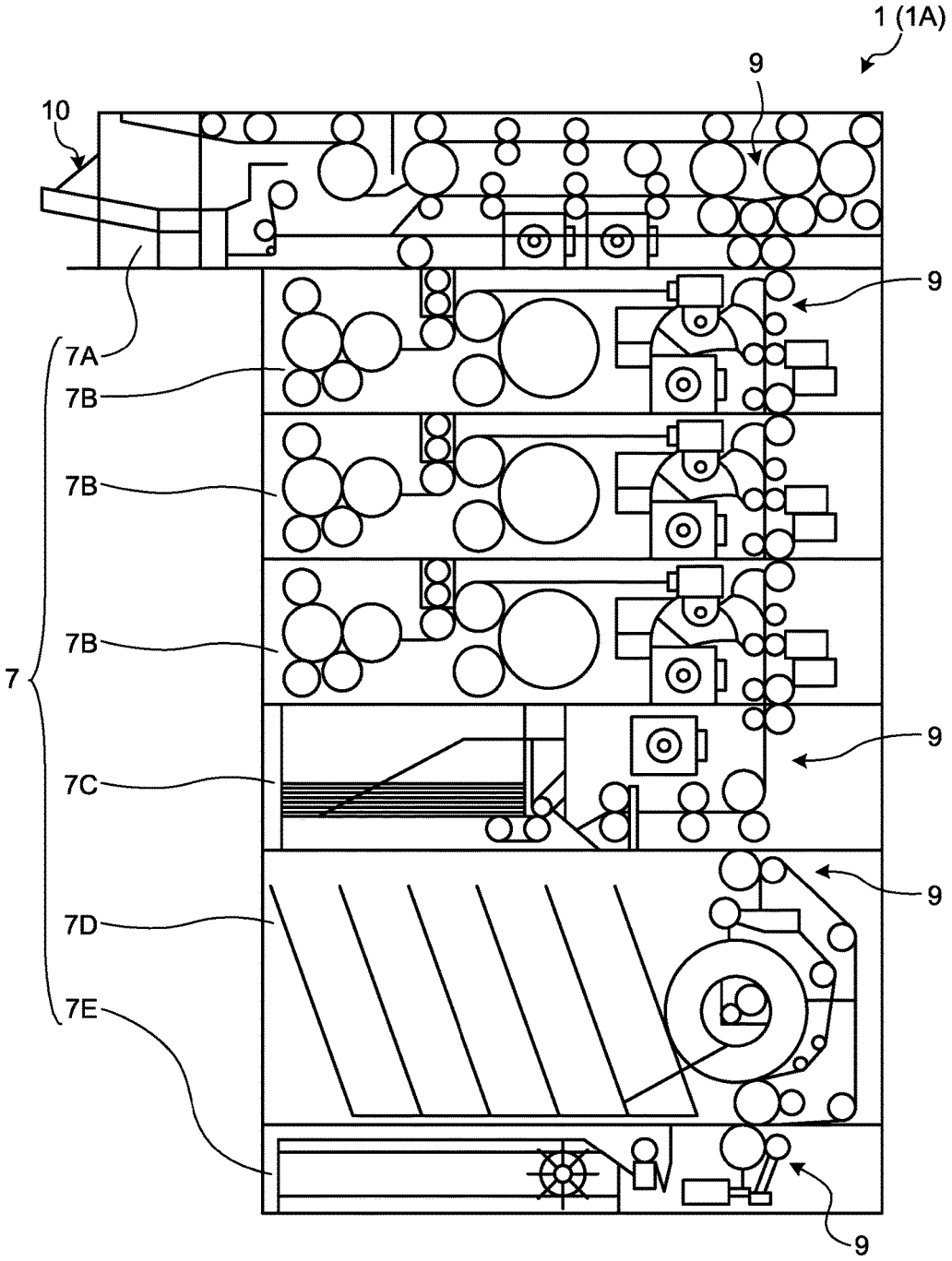
FIG. 1 is a schematic diagram illustrating an example of a banknote handling machine according to an embodiment.
Figure 2:
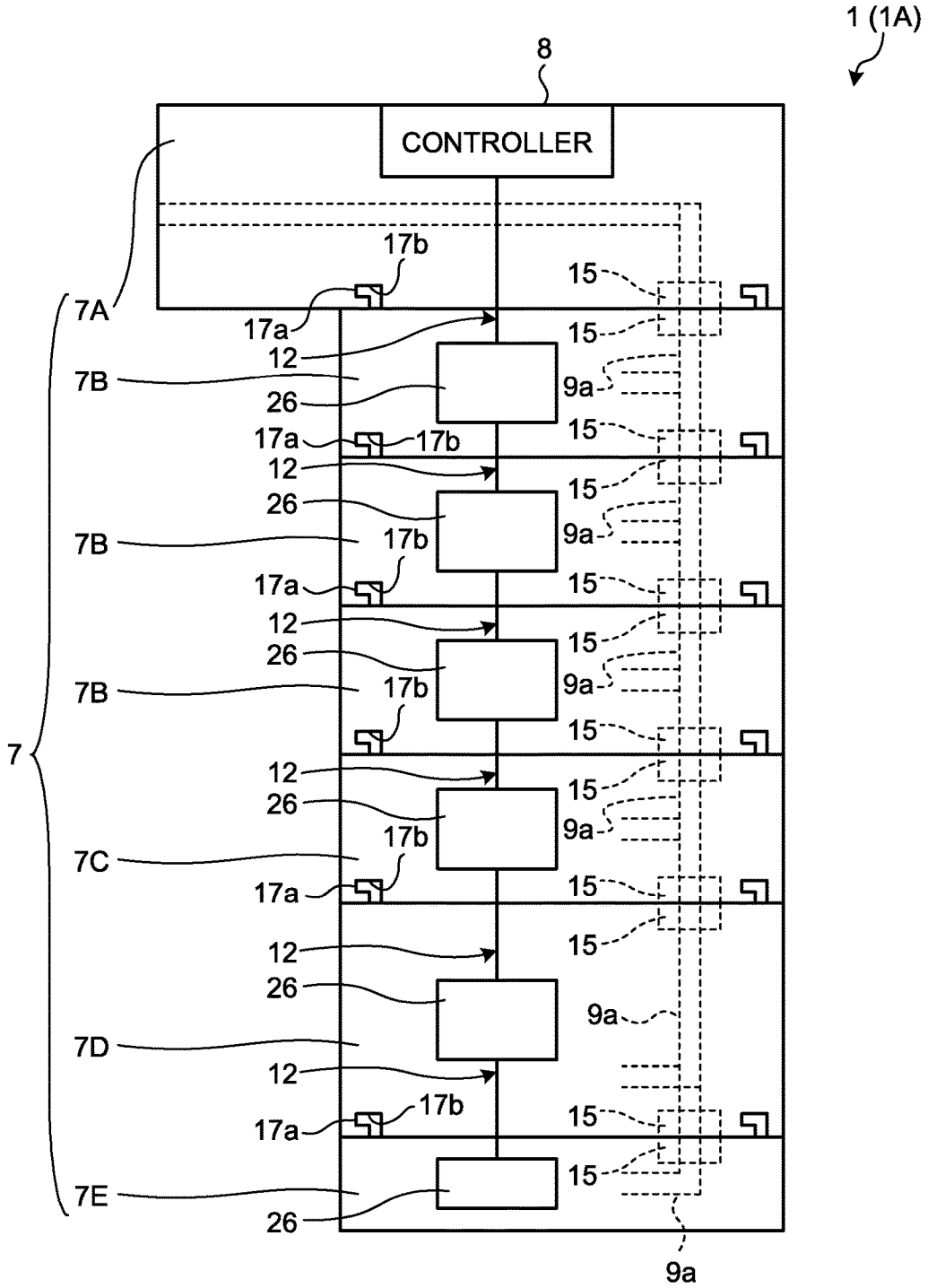
FIG. 2 is a schematic diagram for explaining a connected state and an electrically connected state of a plurality of banknote handling units included in the banknote handling machine in the embodiment.

FIG. 1 is a schematic diagram illustrating an example of a banknote handling machine according to an embodiment. FIG. 2 is a schematic diagram for explaining a connected state and an electrically connected state of a plurality of banknote handling units included in the banknote handling machine in the embodiment.

As illustrated in FIG. 1 and FIG. 2, a banknote handling machine 1 according to the embodiment includes banknote handling units (banknote processing modules) 7 as multiple types of paper sheet handling units that perform different handling processes on banknotes as paper sheets. Furthermore, as illustrated in FIG. 2, the banknote handling machine 1 includes a controller 8 that controls the multiple types of the banknote handling units 7 with respect to each type, and a power supply unit (not illustrated) that supplies power to each of the banknote handling units 7.

The multiple types of the banknote handling units 7 include conveying mechanisms 9 that convey banknotes. Specifically, the banknote handling units 7 in the embodiment include, for example, a discriminating unit 7A that discriminates a banknote to be input and output, a holding unit 7B that temporarily stores therein a banknote conveyed from the discriminating unit 7A, and a stock unit 7C in which a banknote to be output is stocked. Furthermore, the banknote handling units 7 include a storage unit 7D that stores therein a banknote to be output to the outside, and a collecting unit 7E that collects a banknote that is not returned. Hereinafter, when the banknote handling unit 7 is simply used as a term, the term inclusively indicates each of the banknote handling units 7A to 7E.

The banknote handling unit 7 is not limited to the banknote handling units 7A to 7E as described above, and any unit that includes the conveying mechanism 9 for conveying banknotes and that processes the banknotes may be used. Furthermore, while a banknote is used as one example of the sheet paper in the embodiment, the sheet paper is not limited to the banknote, and other sheet papers, such as a cash voucher, may be used.

A banknote handling machine 1A illustrated in FIG. 1, which is one configuration example, includes the discriminating unit 7A, the three holding units 7B, the stock unit 7C, the storage unit 7D, and the collecting unit 7E. In the banknote handling machine 1A, the discriminating unit 7A, the three holding units 7B, the stock unit 7C, the storage unit 7D, and the collecting unit 7E are arranged in this order along a banknote conveying pathway.

In the embodiment, the discriminating unit 7A includes, for example, the controller 8 and an input-and-output unit 10 that inputs and outputs a banknote, and is constructed as a main unit. In contrast, the holding unit 7B, the stock unit 7C, the storage unit 7D, and the collecting unit 7E are constructed as multiple types of sub units that are selectively connected to a main unit.

Each of the above-described banknote handling units 7 has ID information (identification information) for identifying a type of each of the banknote handling units 7 that perform different banknote handling processes, that is, for identifying one of the banknote handling units 7A to 7E. For example, the ID information is stored in a semiconductor memory (not illustrated) or a large-scale integration (LSI) included in the banknote handling unit 7. In the embodiment, a case will be described in which the ID information is stored in the LSI.

Furthermore, the multiple types of the banknote handling units 7 are connected to the controller 8 in a daisy-chain manner via a cable 12, for example. By connecting the banknote handling units 7 in a daisy-chain manner as described above, it becomes possible to optionally set the number of the banknote handling units 7 to be connected to the controller 8, without limitation by the number of communication ports included in a control circuit (not illustrated) of the controller 8. Therefore, it is possible to increase the flexibility to set the number of the multiple types of the banknote handling units 7 to be included in the banknote handling machine 1.

The controller 8 has the ID information assigned to each of the different types of the banknote handling units 7, and control information for controlling drive of each of the banknote handling units 7 for each type. The controller 8 exchanges signals with each of the banknote handling units 7, and detects the type of each of the banknote handling units 7 with respect to the multiple types of the banknote handling units 7 that are connected via connecting portions 15. Similarly, the controller 8 exchanges signals with each of the banknote handling units 7, and detects relative positions of the banknote handling units 7 in the banknote conveying pathway (layer arrangement of the banknote handling units 7 in a stacking direction). Then, the controller 8 appropriately controls each of the multiple types of the banknote handling units 7A to 7E based on the type and the relative position of each of the banknote handling units 7.

Specifically, with respect to the layer of each of the banknote handling units 7, the controller 8 recognizes that the three holding units 7B are arranged in the first layer to the third layer below the discriminating unit 7A arranged in the topmost layer, and causes each of the holding units 7B to hold banknotes. Furthermore, the controller 8 recognizes that the stock unit 7C is arranged in the fourth layer below the holding unit 7B arranged in the third layer, and causes banknotes stocked in the stock unit 7C to be output. Moreover, the controller 8 recognizes that the storage unit 7D is arranged in the fifth layer below the stock unit 7C arranged in the fourth layer, and causes the storage unit 7D to store therein banknotes. Furthermore, the controller 8 recognizes that the collecting unit 7E is arranged in the sixth layer below the storage unit 7D arranged in the fifth layer, and causes the collecting unit 7E to collect banknotes.

Figure 3:
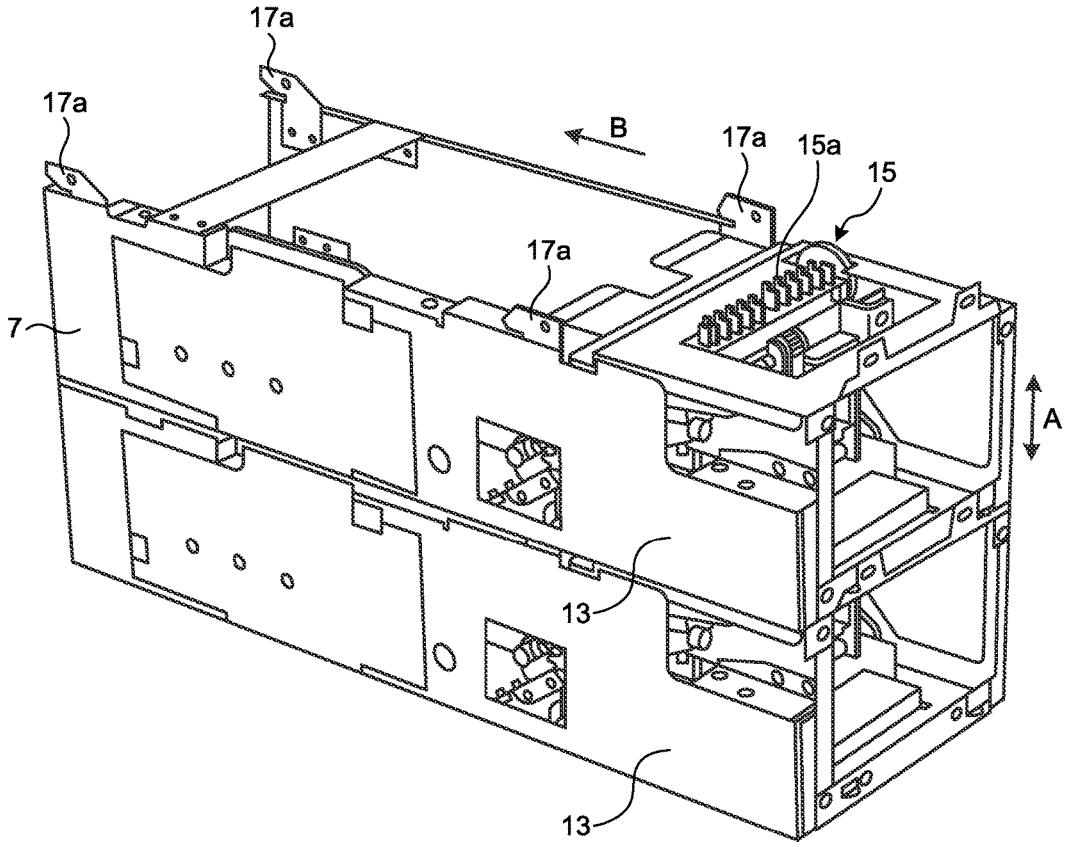
FIG. 3 is a perspective view illustrating a state in which the banknote handling units are connected via connecting portions in the embodiment.
Figure 4:
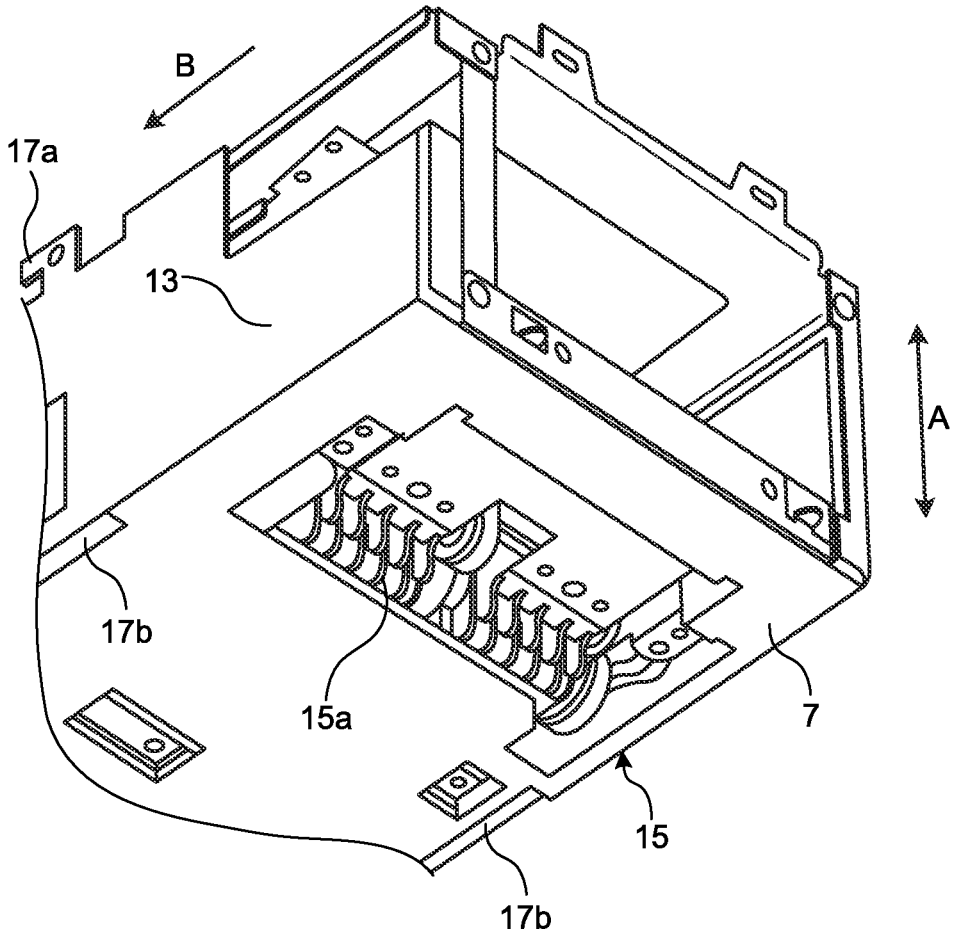
FIG. 4 is a perspective view illustrating the connecting portion of each of the banknote handling units, viewed from the bottom surface side of the banknote handling unit in the embodiment.

FIG. 3 is a perspective view illustrating a state in which the banknote handling units 7 are connected via the connecting portions 15 in the embodiment. FIG. 4 is a perspective view illustrating the connecting portion 15 of each of the banknote handling units 7, viewed from the bottom surface side of the banknote handling unit 7 in the embodiment.

As illustrated in FIG. 3 and FIG. 4, each of the banknote handling units 7 includes a chassis 13 that supports the conveying mechanism 9, various banknote processing mechanisms, and the like. The chassis 13 of each of the banknote handling units 7 has a different height in the vertical direction depending on the type of the banknote handling unit 7; however, external dimensions of a top surface and a bottom surface are made uniform among the different types of the banknote handling units 7. Therefore, the banknote handling machine 1 as a combination of the multiple types of the banknote handling units 7A to 7E has a different height in the vertical direction depending on the combination, but the external dimensions on a horizontal plane are uniform. Therefore, the configuration of an outer chassis (not illustrated) that covers the whole combined banknote handling units 7 can be made uniform.

As illustrated in FIG. 1 and FIG. 2, the conveying mechanism 9 in the banknote handling unit 7 includes a plurality of guide rollers arranged along a conveying path 9*a*, and a conveying belt (not illustrated) is extended around the guide rollers. The conveying path 9*a* includes an entrance port through which a banknote enters, and a discharge port through which a banknote is discharged. At each of the entrance port and the discharge port, the connecting portion 15 for connecting the conveying path 9*a* of each of the conveying mechanisms 9, is provided.

As illustrated in FIG. 3 and FIG. 4, the connecting portions 15 of each of the banknote handling units 7 are provided in common positions (the same positions) on the top surface and the bottom surface of the chassis 13 in all of the multiple types of the banknote handling units 7A to 7E. In the embodiment, the connecting portions 15 of the multiple types of the banknote handling units 7A to 7E are arranged so as to be located on a straight line along the vertical direction. Furthermore, the connecting portion 15 includes a plurality of connecting craws 15*a* that are arranged in two rows along the entrance port and the discharge port, and the conveying path 9*a* is constructed between the rows of the connecting craws 15*a*. When the chassis 13 of the multiple types of the banknote handling units 7 are stacked in a vertical direction A, the connecting portions 15 are connected to one another. When the connecting portions 15 are connected to one another, the plurality of the connecting craws 15*a* are engaged with one another, so that the conveying paths 9*a* are connected between the banknote handling units 7.

Furthermore, the banknote handling unit 7 includes hook pieces 17*a* and hook grooves 17*b*, which serve as engaging units that engage the banknote handling units 7 in a stacked manner (in the vertical direction), in common positions among the multiple types of the banknote handling units 7A to 7E. In each of the banknote handling units 7, the plurality of the hook pieces 17*a* are provided on the top surface of the chassis 13, and the plurality of the hook grooves 17*b*, with which the hook pieces 17*a* are engaged, are provided on the bottom surface of the chassis 13. Moreover, the engaging units are not limited to the hook pieces 17*a* and the hook grooves 17*b*, and various replacements and modifications using other components may be performed as long as the components can engage the banknote handling units 7.

In the banknote handling units 7 stacked in the vertical direction A, by causing the banknote handling unit 7 arranged in the lower side to slide in a direction B illustrated in FIG. 3 and FIG. 4 relative to the banknote handling unit 7 arranged in the upper side, the hook pieces 17*a* of the banknote handling unit 7 in the lower side engage with the hook grooves 17*b* of the banknote handling unit 7 in the upper side. At this time, by sliding the banknote handling unit 7 in the lower side in the direction B relative to the banknote handling unit 7 in the upper side, the connecting craws 15*a* of the connecting portion 15 of the banknote handling unit 7 in the upper side and the connecting craws 15*a* of the connecting portion 15 of the banknote handling unit 7 in the lower side engage with one another, so that the connecting portions 15 are connected to each other. In this manner, by engaging the hook pieces 17*a* and the hook grooves 17*b* while the banknote handling units 7 are stacked in the vertical direction A, the positions of the connecting portions 15 are easily determined and the connecting portions 15 are smoothly connected.

Other configuration examples of the banknote handling machine 1 constructed by a combination of the above-described multiple types of the banknote handling units 7A to 7E will be described below. FIG. 5A to FIG. 5D are schematic diagrams illustrating configuration examples of a banknote handling machine as a combination of the banknote handling units 7 of the banknote handling machine 1 in the embodiment.

Figure 5A:
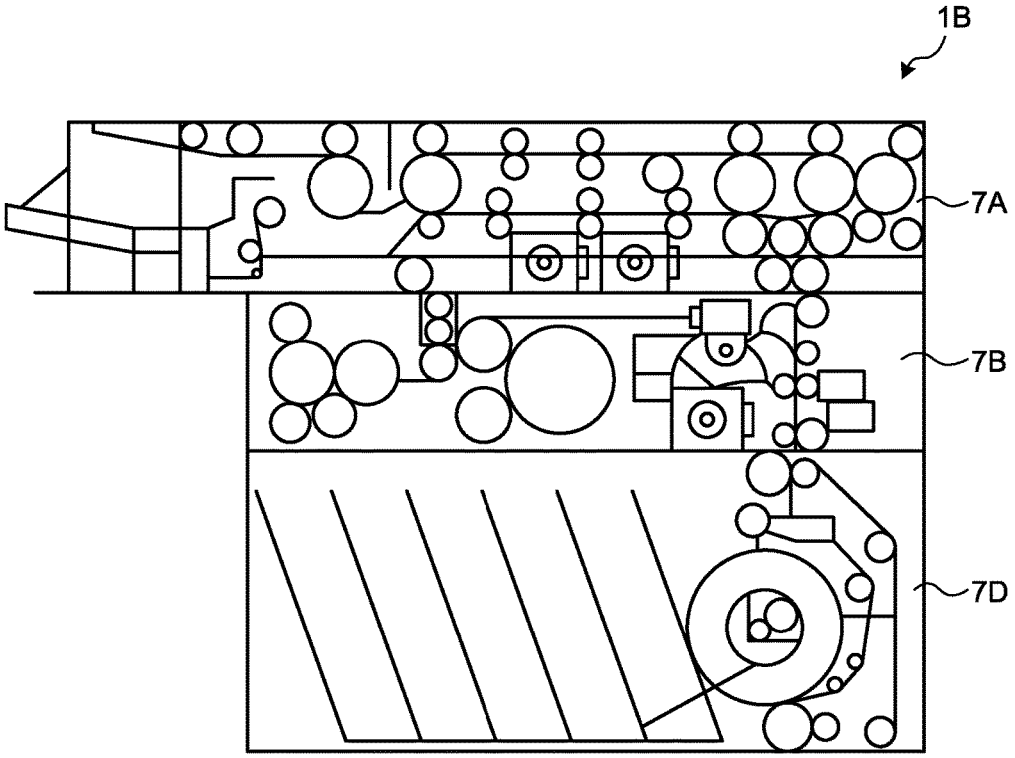
FIG. 5A is a schematic diagram illustrating a configuration example of a banknote handling machine as a combination of the banknote handling units of the banknote handling machine in the embodiment.

As illustrated in FIG. 5A, a banknote handling machine 1B includes the discriminating unit 7A, the holding unit 7B, and the storage unit 7D. In the banknote handling machine 1B, the discriminating unit 7A, the holding unit 7B, and the storage unit 7D are arranged in this order along the banknote conveying pathway.

Figure 5B:
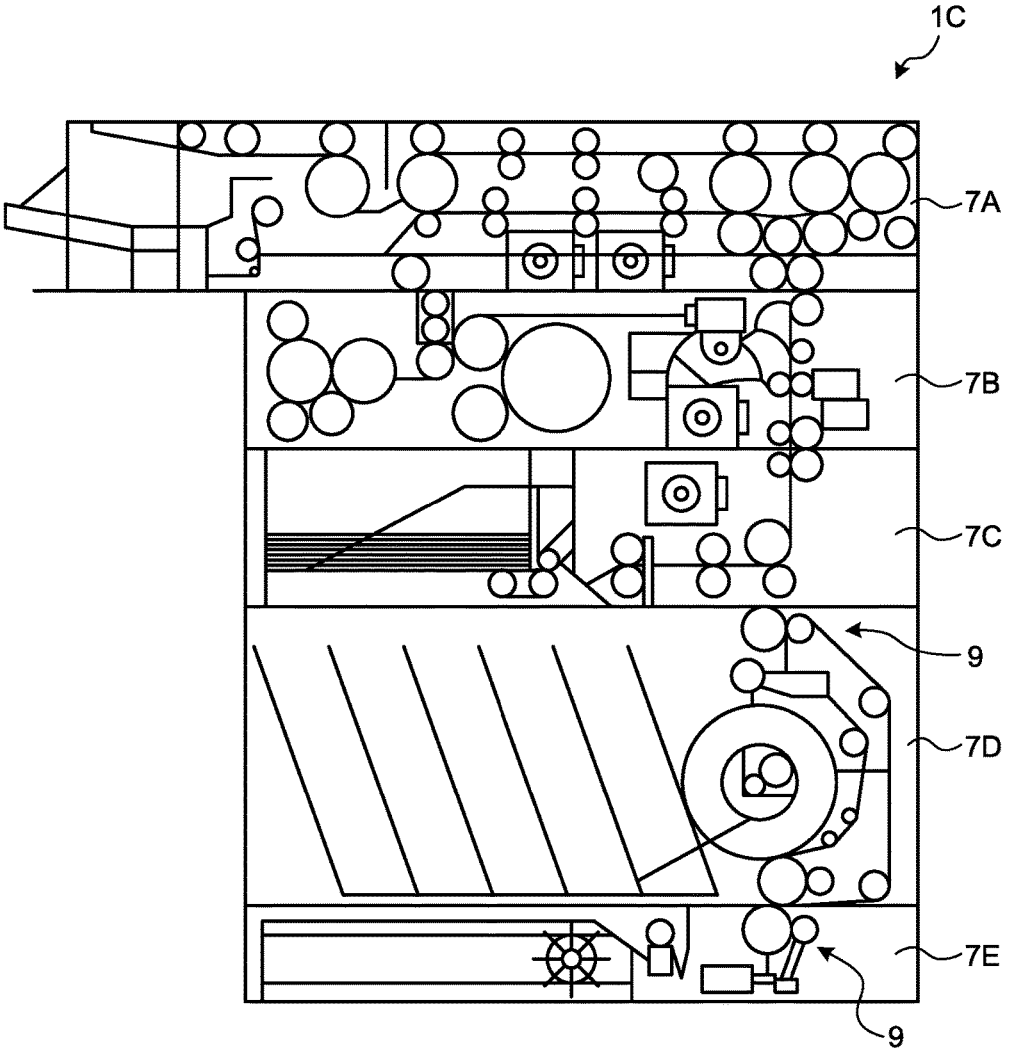
FIG. 5B is a schematic diagram illustrating a configuration example of a banknote handling machine as a combination of the banknote handling units of the banknote handling machine in the embodiment.

Furthermore, as illustrated in FIG. 5B, a banknote handling machine 1C includes the discriminating unit 7A, the holding unit 7B, the stock unit 7C, the storage unit 7D, and the collecting unit 7E. In the banknote handling machine 1C, the discriminating unit 7A, the holding unit 7B, the stock unit 7C, the storage unit 7D, and the collecting unit 7E are arranged in this order along the banknote conveying pathway. In addition, in the banknote handling machine 1C, the relative position of the storage unit 7D with respect to the discriminating unit 7A is different as compared to the banknote handling machine 1B; however, the controller 8 recognizes the relative position of the storage unit 7D, and appropriately controls the storage unit 7D.

Figure 5C:
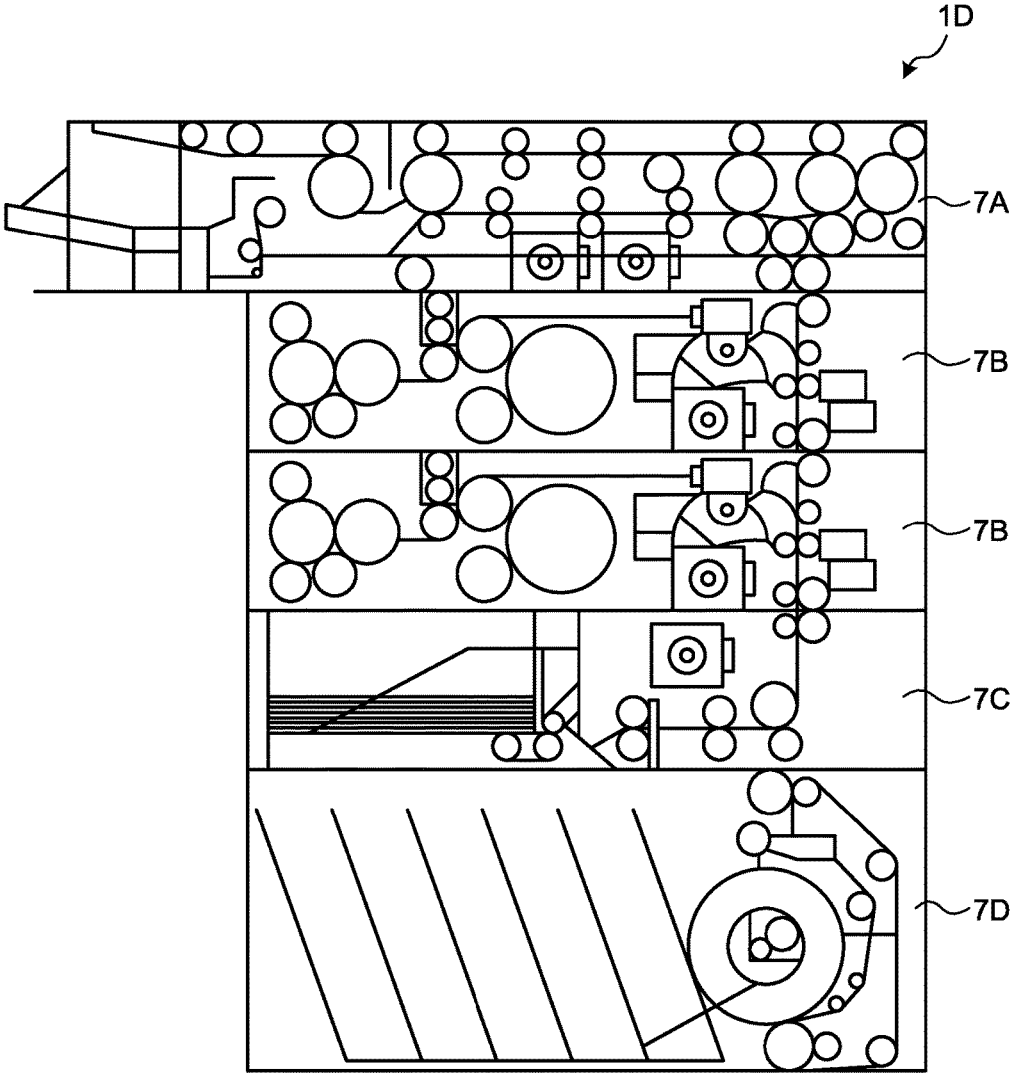
FIG. 5C is a schematic diagram illustrating a configuration example of a banknote handling machine as a combination of the banknote handling units of the banknote handling machine in the embodiment.

Moreover, as illustrated in FIG. 5C, a banknote handling machine 1D includes the discriminating unit 7A, the two holding unit 7B, the stock unit 7C, and the storage unit 7D. In the banknote handling machine 1D, the discriminating unit 7A, the two holding unit 7B, the stock unit 7C, and the storage unit 7D are arranged in this order along the banknote conveying pathway.

Figure 5D:
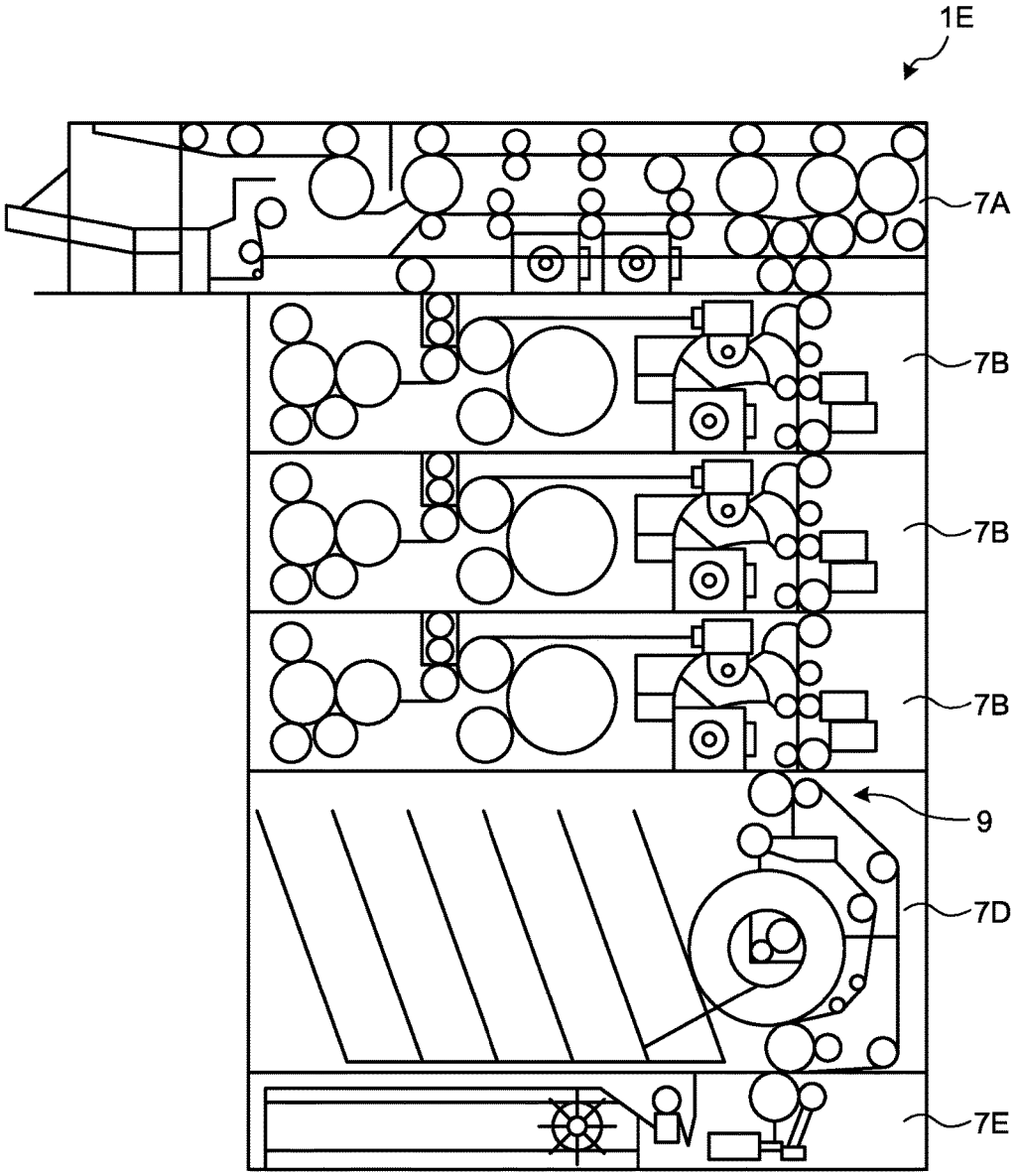
FIG. 5D is a schematic diagram illustrating a configuration example of a banknote handling machine as a combination of the banknote handling units of the banknote handling machine in the embodiment.

Furthermore, as illustrated in FIG. 5D, a banknote handling machine 1E includes the discriminating unit 7A, the three holding units 7B, the storage unit 7D, and the collecting unit 7E. In the banknote handling machine 1E, the discriminating unit 7A, the three holding units 7B, the storage unit 7D, and the collecting unit 7E are arranged in this order along the banknote conveying pathway.

For example, the banknote handling machine 1 may include only the discriminating unit 7A and the storage unit 7D, although this configuration is not illustrated. In this manner, the banknote handling machine 1 with a desired specification can easily be constructed by combining, in an optional order, the necessary numbers of the banknote handling units 7 that are optionally selected from the multiple types of the banknote handling units 7A to 7E.

Hereinafter, when the banknote handling machine 1 is simply used as a term, the term inclusively indicates each of the banknote handling machines 1A to 1E. The banknote handling machine 1 is not limited by the above-described configuration examples, and the number or the order of arrangement of the banknote handling units 7 may be changed appropriately depending on the specification of the banknote handling machine 1.

(Control Based on the Type and the Relative Position of the Banknote Handling Unit)

Figure 6:
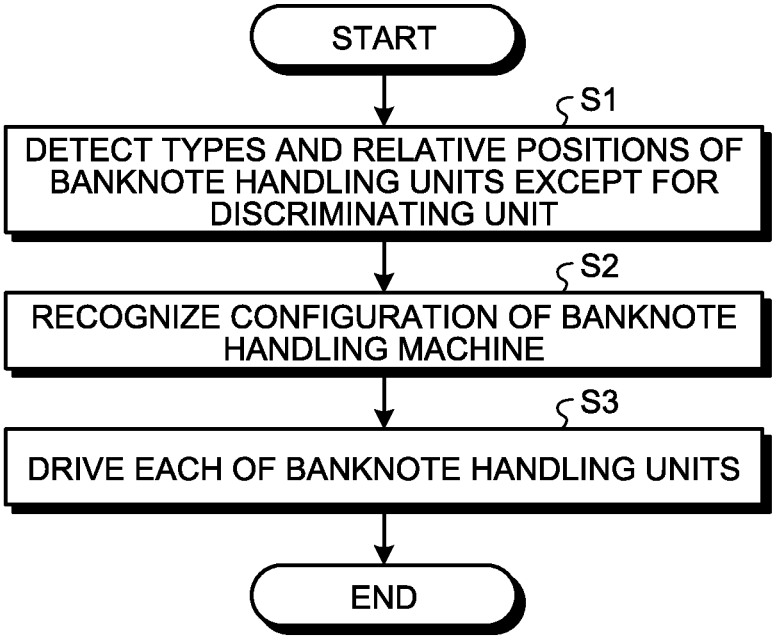
FIG. 6 is a flowchart for explaining a process performed by a controller to control each of the banknote handling units based on a type and a relative position in the banknote handling machine.

FIG. 6 is a flowchart for explaining a process performed by the controller 8 to control each of the banknote handling units 7 based on the type and the relative position in the banknote handling machine 1 according to the embodiment.

First, the banknote handling units 7 that are selected from the above-described banknote handling units 7A to 7E are stacked in accordance with a desired specification, and the conveying paths 9*a* are connected by the connecting portions 15, so that the banknote handling machine 1 as a combination of the optional banknote handling units 7 is constructed.

As illustrated in FIG. 6, the controller 8 detects the types of the banknote handling units 7B to 7E except for the discriminating unit 7A serving as a main unit, and the relative positions of the connected banknote handling units 7 (Step S1). At this time, the controller 8 sends a signal to each of the banknote handling units 7, and detects the type of each of the banknote handling units 7 and the relative positions of the banknote handling units 7 based on a signal returned from each of the banknote handling units 7.

Accordingly, the controller 8 recognizes the configuration of the banknote handling machine 1, that is, a combination and the order of arrangement of the multiple types of the banknote handling units 7A to 7E (Step S2). Then, the controller 8 appropriately controls drive of each of the banknote handling units 7 based on the combination and the order of arrangement of the banknote handling units 7 included in the banknote handling machine 1 (Step S3).

Figure 7:
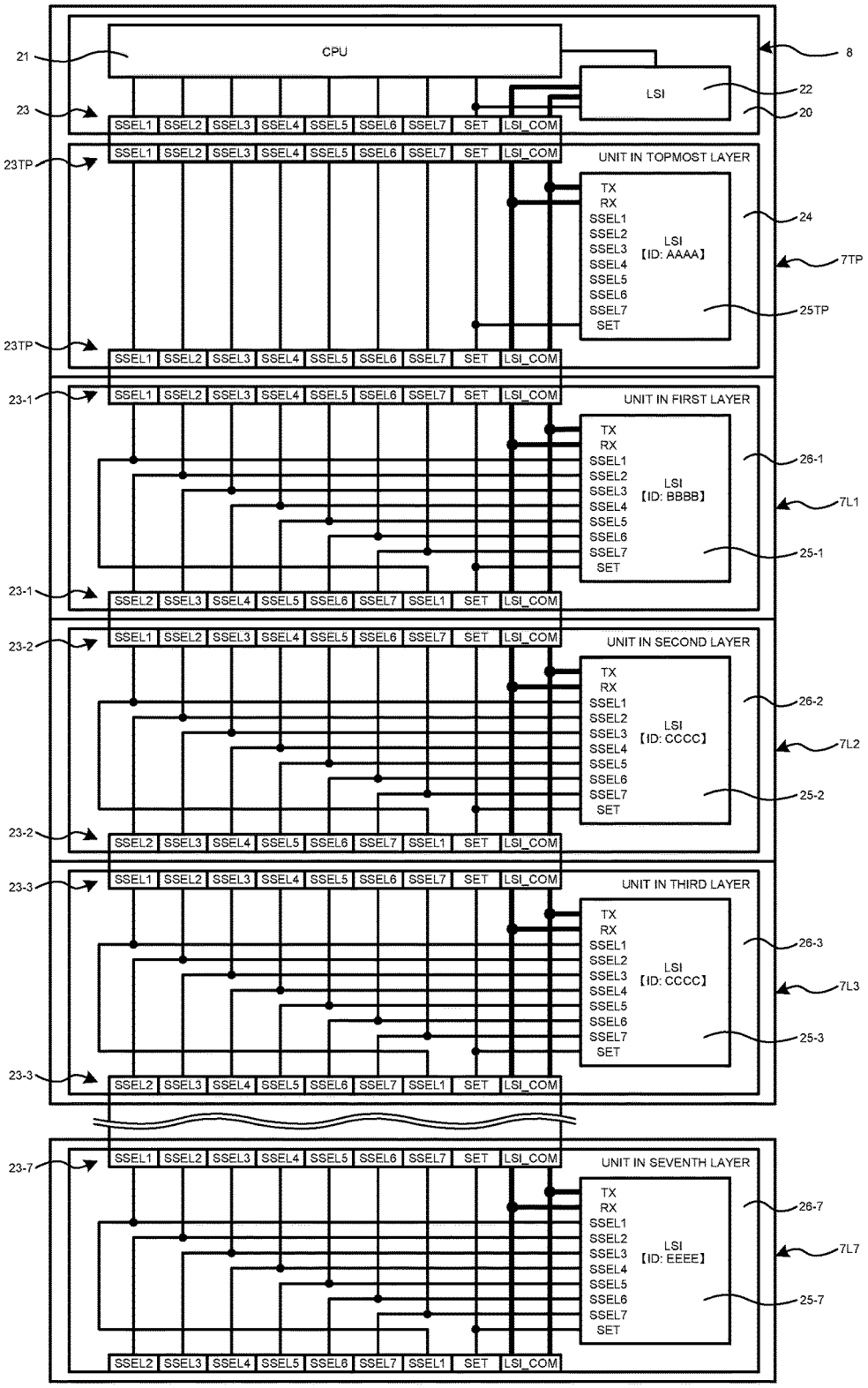
FIG. 7 is a wiring diagram illustrating signal lines with which the controller recognizes the type and the relative position of each of the banknote handling units in the banknote handling machine according to the embodiment.
Figure 8:
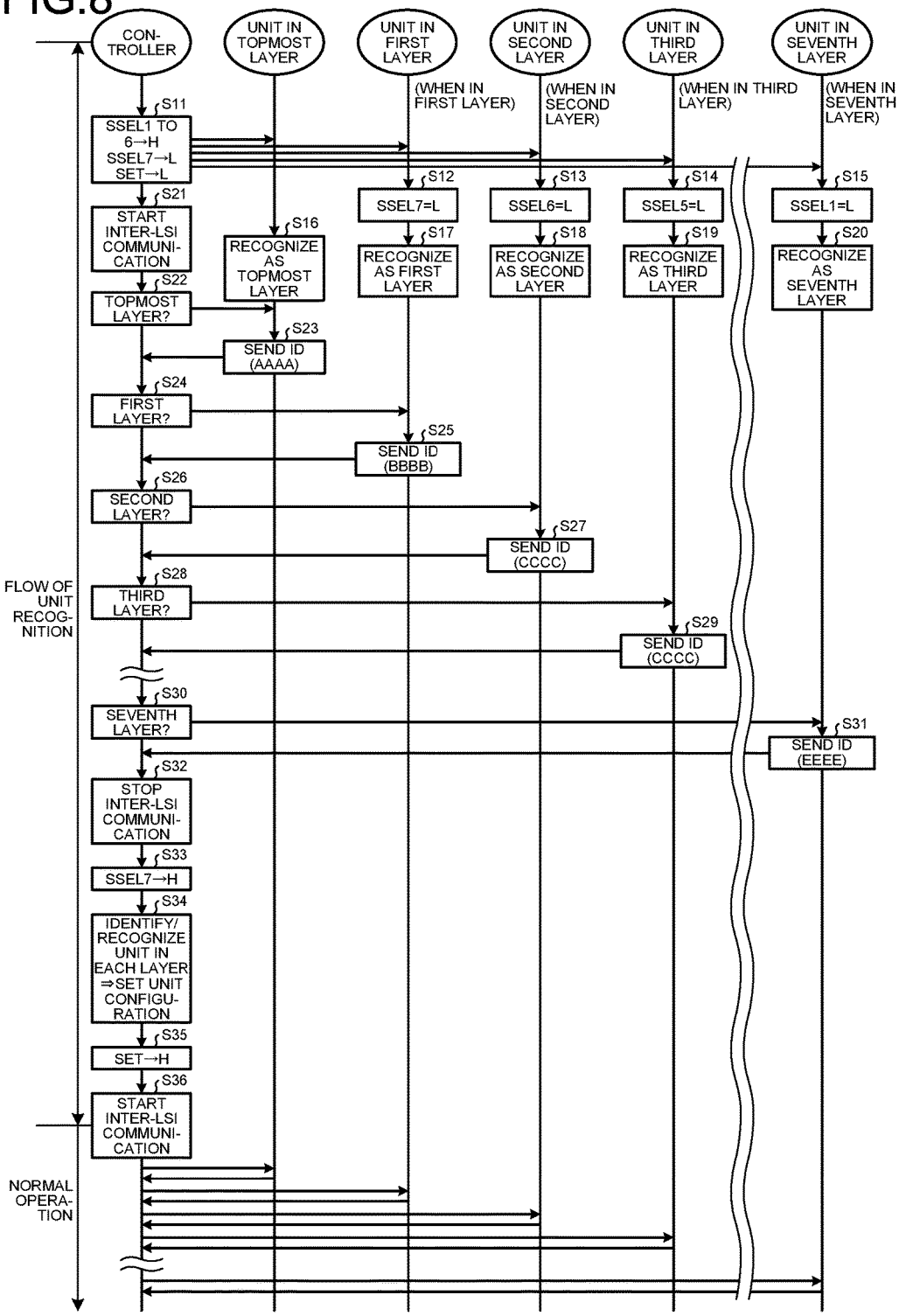
FIG. 8 is a flowchart for explaining a process performed by the controller to recognize the type and the relative position of each of the banknote handling units in the banknote handling machine according to the embodiment.
Figure 10:
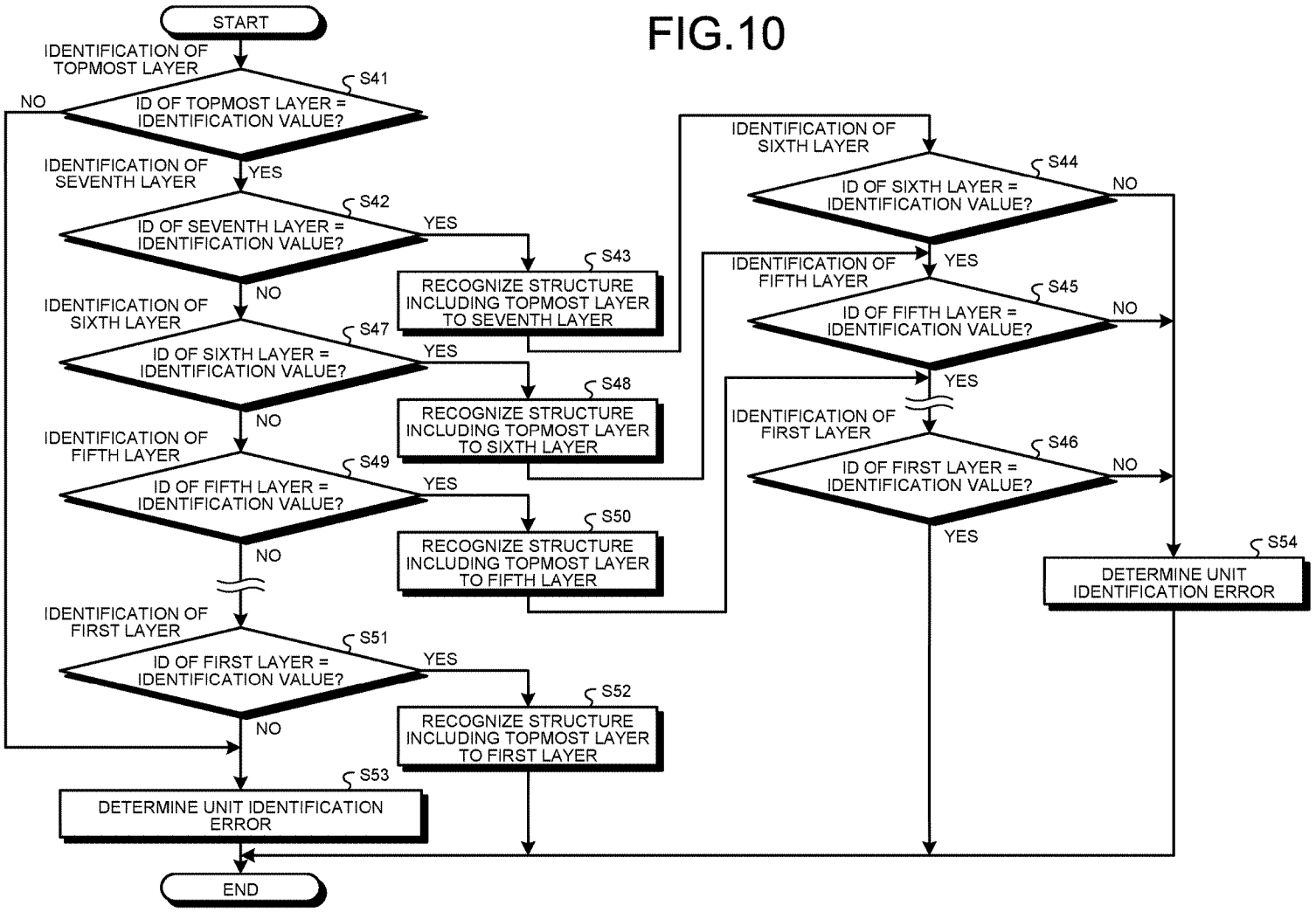
FIG. 10 is a flowchart for explaining a process performed by the controller to recognize the type and the relative position of each of the banknote handling units in the banknote handling machine according to the embodiment.

A process of identifying the types and the arrangement of the above-described multiple types of the banknote handling units 7, will be described in detail below. FIG. 7 is a wiring diagram illustrating signal lines with which the controller 8 recognizes the type and the relative position of each of the banknote handling units 7 in the banknote handling machine 1 according to the embodiment. FIG. 8 is a flowchart for explaining a process performed by the controller 8 to recognize the type and the relative position of each of the banknote handling units 7 in the banknote handling machine 1 according to the embodiment. FIG. 9 is a diagram for explaining setting with which the controller 8 recognizes the relative position of each of the banknote handling units 7 in the banknote handling machine 1 according to the embodiment. FIG. 10 is a flowchart for explaining a process performed by the controller 8 to recognize the type and the relative position of each of the banknote handling units 7 in the banknote handling machine 1 according to the embodiment.

As one example of the banknote handling machine 1, a configuration as illustrated in FIG. 7 will be described, in which the controller 8, a banknote handling unit 7TP in the topmost layer, and a banknote handling unit 7L1 in the first layer to a banknote handling unit 7L7 in the seventh layer are stacked in this order from the top. The controller 8 includes a circuit substrate 20 on which a central processing unit (CPU) 21 and an LSI 22 are mounted. Furthermore, the circuit substrate 20 is provided with a connecting terminal 23 that is connected to the banknote handling unit 7TP in the topmost layer.

The banknote handling unit 7TP in the topmost layer corresponds to, for example, the discriminating unit 7A, and includes a circuit substrate 24 on which an LSI 25TP is mounted. The LSI 25TP is set so as to recognize that the layer of the banknote handling unit 7TP in the topmost layer is the topmost layer. Furthermore, the circuit substrate 24 is provided with connecting terminals 23TP that are connected to the controller 8 and the banknote handling unit 7L1 in the first layer arranged just below. The banknote handling unit 7L1 in the first layer includes a circuit substrate 26-1 on which an LSI 25-1 is mounted. The circuit substrate 26-1 is provided with connecting terminals 23-1 that are connected to the banknote handling unit 7TP in the topmost layer and the banknote handling unit 7L2 in the second layer arranged just below, similarly to the circuit substrate 24 of the banknote handling unit 7TP in the topmost layer.

In the lower side of the banknote handling unit 7L1 in the first layer, the banknote handling unit 7L2 in the second layer to the banknote handling unit 7L7 in the seventh layer, are arranged in a stacked manner. The banknote handling unit 7L2 in the second layer to the banknote handling unit 7L7 in the seventh layer respectively include a circuit substrate 26-2, on which an LSI 25-2 is mounted, to a circuit substrate 26-7, on which an LSI 25-7 is mounted, similarly to the banknote handling unit 7L1 in the first layer, where the circuit substrates 26 (26-2 to 26-7) provided with the LSIs 25 (25-2 to 25-7) as the same semiconductor devices with the same wiring patterns are used. Furthermore, the circuit substrates 26 (26-2 to 26-7) included in the banknote handling unit 7L2 in the second layer to the banknote handling unit 7L7 in the seventh layer are provided with connecting terminals 23 (23-2 to 23-7) that are connected to one another, similarly to the circuit substrate 26-1 of the banknote handling unit 7L1 in the first layer. In this manner, the circuit substrates 26 (26-1 to 26-7) are made common to the banknote handling unit 7L1 in the first layer to the banknote handling unit 7L7 in the seventh layer; therefore, it is possible to identify the layers of the banknote handling unit 7L1 in the first layer to the banknote handling unit 7L7 in the seventh layer by using only 1-bit select signals transmitted from a select signal line SSEL of the CPU 21, which will be described later.

As illustrated in FIG. 7, each of the LSIs 25 (25-1 to 25-7) of the circuit substrates 26 (26-1 to 26-7) includes, as signal lines, a transmission line TX, a reception line RX, a first select signal line SSEL1 to a seventh select signal line SSEL7 for identifying the layers of the banknote handling units 7, and a start signal line SET for starting identification of the layers. Furthermore, while each of the LSIs 25-1 to 25-7 includes the seven select signal lines SSEL1 to SSEL7 to identify the banknote handling unit 7L1 in the first layer to the banknote handling unit 7L7 in the seventh layer in one example as illustrated in FIG. 7, if the banknote handling unit 7L1 in the first layer to a banknote handling unit 7Ln in the n-th layer are to be identified, each of the LSIs 25 (25TP and 25-1 to 25-*n*) includes n select signal lines SSEL1 to SSELn.

Moreover, in each of the LSIs 25-1 to 25-7 of the banknote handling unit 7TP in the topmost layer and the banknote handling unit 7L1 in the first layer to the banknote handling unit 7L7 in the seventh layer, ID information including a type of the subject banknote handling unit 7, is stored. The same ID information is stored in the same type of the banknote handling units 7. For example, as illustrated in FIG. 7, in each of the LSIs 25-1 to 25-7 of the banknote handling units 7L1 to 7L7, "AAAA", "BBBB", . . . , or "EEEE" is stored as the ID information including the type, for example.

Furthermore, as illustrated in FIG. 7, each of the connecting terminals 23-1 to 23-7 of the circuit substrates 26-1 to 26-7 includes terminal lines corresponding to the above-described respective signal lines of each of the LSIs 25-1 to 25-7, and a communication terminal LSI_COM for transmitting and receiving the ID information including the type of the banknote handling unit 7, a control signal, or the like.

A process of identifying the banknote handling unit 7L1 in the first layer to the banknote handling unit 7L7 in the seventh layer in the banknote handling machine 1 configured as above will be described below. First, as illustrated in FIG. 8, the controller 8 sends signals for setting the select signal lines SSEL1 to SSEL6 to "H" and setting the select signal line SSEL7 to "L" to the LSIs 25-1 to 25-7 in the respective layers, and sets the start signal lines SET to "L" to start identification (Step S11). The banknote handling unit 7L1 in the first layer receives the signal for setting the seventh select signal line SSEL7 to "L" from the controller 8, so that only the seventh select signal line SSEL7 in the LSI 25-1 is set to "L" (Step S12).

Similarly, the banknote handling unit 7L2 in the second layer receives the signal for setting the seventh select signal line SSEL7 to "L" from the controller 8, so that only the sixth select signal line SSEL6 in the LSI 25-2 is set to "L" (Step S13). Similarly, only the fifth select signal line SSEL5 in the LSI 25-3 of the banknote handling unit 7L3 in the third layer is set to "L" (Step S14). Furthermore, similarly, only the fourth select signal line SSEL4 in the LSI 25-4 of the banknote handling unit 7L4 in the fourth layer is set to "L", and only the third select signal line SSEL3 in the LSI 25-5 of the banknote handling unit 7L5 in the fifth layer is set to "L". Moreover, similarly, only the second select signal line SSEL2 in the LSI 25-6 of the banknote handling unit 7L6 in the sixth layer is set to "L", and only the first select signal line SSEL1 in the LSI 25-7 of the banknote handling unit 7L7 in the seventh layer is set to "L" (Step S15). Meanwhile, "L" corresponds to "0", and "H" corresponds to "1", for example.

Therefore, as illustrated in FIG. 9, in each of the banknote handling unit 7L1 in the first layer to the banknote handling unit 7L7 in the seventh layer, only any one of the select signal lines among the first select signal line SSEL1 to the seventh select signal line SSEL7 is automatically set to "L", and the remaining six select signal lines remain "H". In this manner, the controller 8 sends a signal for setting the seventh select signal line SSEL7 to "L" to each of the layers, so that any one of the select signal lines SSEL is set to "L" for each of the banknote handling unit 7L1 in the first layer to the banknote handling unit 7L7 in the seventh layer, and the banknote handling unit 7TP in the topmost layer, each of the banknote handling unit 7L1 in the first layer to the banknote handling unit 7L7 in the seventh layer recognizes own layer (Step S16 to Step S20).

Subsequently, the controller 8 starts communication between the LSI 25TP of the banknote handling unit 7TP in the topmost layer and each of the LSIs 25-1 to 25-7 of the banknote handling units 7L1 to 7L7 in the first layer to the seventh layer (Step S21). Then, the controller 8 sends an inquiry about the banknote handling unit 7TP in the topmost layer to each of the banknote handling units 7TP and 7L1 to 7L7 (Step S22). In response to this, the banknote handling unit 7TP in the topmost layer sends the ID information "AAAA" including the own type to the controller 8 (Step S23), and the controller 8 identifies the type of the banknote handling unit 7TP in the topmost layer.

The controller 8 continuously sends an inquiry about the banknote handling unit 7L1 in the first layer to each of the banknote handling units 7TP and 7L1 to 7L7 (Step S24). In response to this, the banknote handling unit 7L1 in the first layer, which recognizes itself as the first layer, sends the ID information "BBBB" including the type to the controller 8 (Step S25), and the controller 8 identifies the type of the banknote handling unit 7L1 in the first layer. Similarly, the controller 8 sends an inquiry about the banknote handling unit 7L2 in the second layer to each of the banknote handling units 7TP and 7L1 to 7L7 (Step S26). In response to this, the banknote handling unit 7L2 in the second layer, which recognizes itself as the second layer, sends the ID information "CCCC" including the type to the controller 8 (Step S27), and the controller 8 identifies the type of the banknote handling unit 7L2 in the second layer.

Furthermore, similarly, the controller 8 sends an inquiry about the banknote handling unit 7L3 in the third layer (Step S28), and the banknote handling unit 7L3 in the third layer sends the ID information "CCCC" including the type to the controller 8 (Step S29), so that the type of the banknote handling unit 7L3 in the third layer is identified. Subsequently, the controller 8 sends an inquiry about each of the banknote handling units 7L4 to 7L6 in the fourth layer to the sixth layer, and the banknote handling units 7L4 to 7L6 in the fourth layer to the sixth layer send the ID information including the types to the controller 8, so that the types of the banknote handling unit 7L4 to 7L6 in the fourth layer to the sixth layer are identified. Lastly, the controller 8 sends an inquiry about the banknote handling unit 7L7 in the seventh layer (Step S30), and the banknote handling unit 7L7 in the seventh layer sends the ID information "EEEE" including the type to the controller 8 (Step S31), so that the type of the banknote handling unit 7L7 in the seventh layer is identified.

Then, the controller 8 stops communication between the LSI 25TP of the banknote handling unit 7TP in the topmost layer and each of the LSIs 25-1 to 25-7 of the banknote handling units 7L1 to 7L7 in the first layer to the seventh layer (Step S32). Subsequently, the controller 8 sends a signal for setting the select signal line SSEL7 to "H" to each of the LSIs 25-1 to 25-7 of the banknote handling unit 7L1 in the first layer to the banknote handling unit 7L7 in the seventh layer (Step S33). Therefore, the select signal line SSEL that has been set to "L" in each of the LSIs 25-1 to 25-7 of the banknote handling unit 7L1 in the first layer to the banknote handling unit 7L7 in the seventh layer is reset to "H", and each of the LSIs 25-1 to 25-7 is returned to the initial state in which all of the seven select signal lines SSEL are set to "H".

Subsequently, the controller 8 performs a process of identifying the layers (the relative positions) and the types of the banknote handling units 7L1 to 7L7 and setting a unit configuration (Step S34). The process at Step S34 will be described in detail later. Lastly, the controller 8 sets the start signal lines SET in the LSI 25TP of the banknote handling unit 7TP in the topmost layer and the LSIs 25-1 to 25-7 of the banknote handling units 7L1 to 7L7 in the first layer to the seventh layer to "H" and ends the identification (Step S35). Then, the controller 8 starts communication between the LSIs 25-1 to 25-7 based on the recognized unit configuration of the banknote handling machine 1 (Step S36). Consequently, the controller 8 can appropriately control the banknote handling unit 7TP in the topmost layer and the banknote handling units 7L1 to 7L7 in the first layer to the seventh layer depending on the types.

A unit configuration setting process at Step S34 in FIG. 8, will be described below with reference to FIG. 10. First, the controller 8 determines whether the ID information (an identification value), such as "AAAA", sent from the banknote handling unit 7TP in the topmost layer matches an identification value that is ID information on each of types stored in advance in the LSI 22 of the controller 8 (Step S41). At Step S41, if the ID information sent from the banknote handling unit 7TP in the topmost layer does not match the identification value (NO), the controller 8 determines an identification error for the banknote handling unit 7TP in the topmost layer, and ends the identification process (Step S53).

At Step S41, if the ID information sent from the banknote handling unit 7TP in the topmost layer matches the identification value (YES), the controller 8 continuously determines whether the ID information (the identification value), such as "EEEE", sent from the banknote handling unit 7L7 in the seventh layer matches the identification value stored in the LSI 22 of the controller 8 (Step S42). At Step S42, if the ID information sent from the banknote handling unit 7L7 in the seventh layer matches the identification value (YES), the controller 8 recognizes a layer structure including the banknote handling unit 7TP in the topmost layer to the banknote handling unit 7L7 in the seventh layer (Step S43). The controller 8 continuously determines whether the ID information (the identification value), such as "EEEE", sent from the banknote handling unit 7L6 in the sixth layer matches the identification value stored in the LSI 22 of the controller 8 (Step S44).

At Step S44, if the ID information sent from the banknote handling unit 7L6 in the sixth layer matches the identification value (YES), the controller 8 determines whether the identification value sent from the banknote handling unit 7L5 in the fifth layer matches the identification value stored in the LSI 22 of the controller 8 (Step S45). At Step S45, if the ID information sent from the banknote handling unit 7L5 in the fifth layer matches the identification value (YES), the controller 8 subsequently determines whether the ID information sent from each of the banknote handling units 7L4 to 7L2 in the fourth layer to the second layer, matches the identification value stored in the LSI 22 of the controller 8, in order of the fourth layer, the third layer, and the second layer. If the ID information sent from the banknote handling unit 7L2 in the second layer matches the identification value (YES), the controller 8 determines whether the identification value sent from the banknote handling unit 7L1 in the first layer matches the identification value stored in the LSI 22 of the controller 8 (Step S46). At Step S46, if the ID information sent from the banknote handling unit 7L1 in the first layer matches the identification value (YES), the controller 8 identifies the types and the layers of the banknote handling unit 7TP in the topmost layer and the banknote handling units 7L7 to 7L1 in the seventh layer to the first layer.

Meanwhile, at Step S42 as described above, if the ID information sent from the banknote handling unit 7L7 in the seventh layer does not match the identification value (NO), the controller 8 determines whether the identification value sent from each of the banknote handling units 7L6 to 7L1 in the sixth layer to the first layer matches the identification value stored in the LSI 22 of the controller 8, in order of the sixth layer, the fifth layer, . . . , and the first layer (Steps S47, S49, and S51). At Step S51, if the identification value sent from the banknote handling unit 7L1 in the first layer does not match the identification value stored in the LSI 22 of the controller 8 (NO), the controller 8 determines an identification error for the banknote handling units 7L7 to 7L1 in the seventh layer to the first layer, and ends the identification process (Step S53).

In contrast, at any one of Steps S47, S49, and S51, if the ID information sent from any one of the banknote handling units 7L6 to 7L1 in the sixth layer to the first layer matches the identification value (YES), the controller 8 recognizes a layer structure including the banknote handling unit 7TP in the topmost layer to any one of the banknote handling units 7L6 to 7L1 in the sixth layer to the first layer (Steps S48, S50, and S52). At Step S52, when the controller 8 identifies a layer structure including the banknote handling unit 7TP in the topmost layer and the banknote handling unit 7L1 in the first layer, the controller 8 normally ends the identification process.

At Steps S48 and S50 for example, after the controller 8 identifies the layer structure of the banknote handling machine 1, the controller 8 determines whether the ID information on each of the banknote handling units 7L5 to 7L1 in the respective layers matches the identification value, in order of the fifth layer, the fourth layer, the third layer, . . . (YES at Steps S45 and S46, for example). At Step S46, the controller 8 identifies the banknote handling unit 7L1 in the first layer, and then normally ends the identification process. Furthermore, at Steps S45 and S46 for example, if the ID information on each of the banknote handling units 7L5 to 7L1 in the respective layers does not match the identification value (NO), the controller 8 determines an identification error for the banknote handling units 7, and ends the identification process (Step S54).

By performing the identification process as described above, the controller 8 can improve the accuracy of identification of the layers of the banknote handling units 7, so that it becomes possible to prevent false recognition when a banknote handling unit with a different specification that is not applicable to the banknote handling machine 1, is connected by mistake.

Furthermore, as a control method for controlling the banknote handling machine 1 according to the embodiment, the controller 8 detects the type of each of the banknote handling units 7 and the relative positions of the banknote handling units 7 in a conveying pathway of a banknote, with respect to the multiple types of the banknote handling units 7 that are connected via the connecting portions 15. In the control method, the controller 8 controls each of the multiple types of the banknote handling units 7A to 7E based on the type and the relative position.

The banknote handling machine 1 according to the embodiment, includes the controller 8 that controls each of the multiple types of the banknote handling units 7A to 7E based on the type and the relative position of each of the banknote handling units 7, with respect to the multiple types of the banknote handling units 7A to 7E 7 that are connected via the connecting portions 15. Therefore, in the embodiment, by combining the banknote handling units 7 that are optionally selected from the multiple types of the banknote handling units 7A to 7E, it is possible to easily construct the banknote handling machine 1 with a desired specification. Consequently, it is possible to improve the productivity of multiple types of the banknote handling machines 1 with different specifications.

In addition, in the banknote handling machine 1, the connecting portions 15 are provided in common positions among the multiple types of the banknote handling units 7A to 7E; therefore, it is possible to easily connect the conveying paths 9*a* of the multiple types of the banknote handling units 7 via the connecting portions 15.

Furthermore, in the banknote handling machine 1, the banknote handling units 7 are connected to the controller 8 in a daisy-chain manner; therefore, it is possible to construct the banknote handling machine 1 with a desired specification without limitation on the number of the banknote handling units 7 included in the banknote handling machine 1.

In addition, according to the banknote handling machine 1, it is possible to increase the number of each of the banknote handling units 7 or change the configuration of each of the banknote handling units 7 if needed. Furthermore, if an optional one of the banknote handling units 7 included in the banknote handling machine 1, is broken, it is possible to replace only the optional one of the banknote handling units 7, so that it is possible to promptly repair the banknote handling machine 1.

Furthermore, according to the banknote handling machine 1 of the embodiment, the connecting portions 15 are connected to one another when the banknote handling units 7 are engaged with one another by the hook pieces 17*a* and the hook grooves 17*b* that are provided in common positions among the multiple types of the banknote handling units 7A to 7E. Therefore, when the banknote handling units 7 are connected to one another via the connecting portions 15, the positions of the connecting portions 15 are easily determined and the connecting portions 15 are smoothly connected.

Moreover, in the banknote handling machine 1 according to the embodiment, the controller 8 is provided in the discriminating unit 7A. Therefore, when the controller 8 detects the types and the relative positions of the multiple types of the banknote handling units 7, it is sufficient to detect the banknote handling units 7B to 7E serving as sub units, except for the discriminating unit 7A serving as a main unit. Consequently, it is possible to simplify a process for detecting the types and the relative positions of the banknote handling units 7.

According to an embodiment of a paper sheet handling machine disclosed in the present application, it is possible to easily construct a paper sheet handling machine with a desired specification.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet handling machine comprising:

multiple types of paper sheet handling units, each of which includes a conveying mechanism for conveying a paper sheet and performs a different handling process on the paper sheet; and a controller that controls the multiple types of the paper sheet handling units, wherein each of the multiple types of the paper sheet handling units includes a circuit substrate that is made common to the multiple types of the paper sheet handling units, and a connecting portion that connects conveying paths of the conveying mechanisms, the connecting portions are provided in common positions among the multiple types of the paper sheet handling units, and the controller detects types of the paper sheet handling units and detects relative positions of the paper sheet handling units in a conveying pathway of the paper sheet only by a signal sent from a single signal line in a semiconductor device included in the circuit substrate, with respect to the multiple types of the paper sheet handling units that are connected via the connecting portions, and controls each of the multiple types of the paper sheet handling units based on the type and the relative position.

2. The paper sheet handling machine according to claim 1, wherein the multiple types of the paper sheet handling units are connected to the controller in a daisy-chain manner.

3. The paper sheet handling machine according to claim 1, wherein each of the multiple types of the paper sheet handling units includes an engaging unit that engages the paper sheet handling units in a stacked manner, the engaging units are provided in common positions among the multiple types of the paper sheet handling units, and the connecting portions are connected to one another when the paper sheet handling units are engaged with one another by the engaging units.

4. The paper sheet handling machine according to claim 1, wherein the multiple types of the paper sheet handling units include:

a discriminating unit that discriminates the paper sheet, and a holding unit that temporarily stores therein the paper sheet, as at least one paper sheet handling unit among the multiple types of the paper sheet handling units.

5. The paper sheet handling machine according to claim 1, wherein the multiple types of the paper sheet handling units include a discriminating unit that discriminates the paper sheet as at least one paper sheet handling unit among the multiple types of the paper sheet handling units, and the controller is provided in the discriminating unit.

6. A method of controlling a paper sheet handling machine including:

multiple types of paper sheet handling units, each of which includes a conveying mechanism for conveying a paper sheet and performs a different handling process on the paper sheet; and a controller that controls the multiple types of the paper sheet handling units, wherein each of the multiple types of the paper sheet handling units includes a circuit substrate that is made common to the multiple types of the paper sheet handling units, and a connecting portion that connects conveying paths of the conveying mechanisms, and the connecting portions are provided in common positions among the multiple types of the paper sheet handling units, the method comprising:

detecting types of the paper sheet handling units and detecting relative positions of the paper sheet handling units in conveying pathway of the paper sheet only by a signal sent from a single signal line in a semiconductor device included in the circuit substrate, with respect to the multiple types of the paper sheet handling units that are connected via the connecting portions; and controlling each of the multiple types of the paper sheet handling units based on the type and the relative position.

* * * * *